US006869326B2

(12) United States Patent
Richard

(10) Patent No.: US 6,869,326 B2
(45) Date of Patent: Mar. 22, 2005

(54) CONTAINER FOR PNEUMATIC INFLATABLE LIFE RAFT, AND PNEUMATIC INFLATABLE LIFE RAFT EQUIPPED WITH SAME

(75) Inventor: Alain Richard, Montendre (FR)

(73) Assignee: Zodiac International, Issy les Moulineaux (FR)

( * ) Notice: Subject to any disclaimer, the term of this patent is extended or adjusted under 35 U.S.C. 154(b) by 0 days.

(21) Appl. No.: 10/311,482

(22) PCT Filed: Jun. 15, 2001

(86) PCT No.: PCT/FR01/01877

§ 371 (c)(1),
(2), (4) Date: Dec. 16, 2002

(87) PCT Pub. No.: WO01/98139

PCT Pub. Date: Dec. 27, 2001

(65) Prior Publication Data

US 2003/0171045 A1 Sep. 11, 2003

(30) Foreign Application Priority Data

Jun. 21, 2000 (FR) ..... 00 07919

(51) Int. Cl.[7] ..... B63B 35/58
(52) U.S. Cl. ..... 441/42
(58) Field of Search ..... 441/42; 114/365, 114/366

(56) References Cited

U.S. PATENT DOCUMENTS

| | | | | |
|---|---|---|---|---|
| 2,851,078 A | | 9/1958 | Mellon et al. | |
| 3,084,830 A | * | 4/1963 | Koelsch | 206/504 |
| 3,113,690 A | * | 12/1963 | Swenck | 220/1.5 |
| 3,387,811 A | | 6/1968 | Adams, Jr. | |
| 4,124,911 A | * | 11/1978 | Wildhagen | 114/367 |
| 4,989,741 A | * | 2/1991 | Dull et al. | 220/1.5 |
| 5,816,410 A | * | 10/1998 | Nyseth | 206/711 |
| 6,079,580 A | * | 6/2000 | Garton et al. | 220/1.5 |

FOREIGN PATENT DOCUMENTS

| | | |
|---|---|---|
| DE | 1636054 | 2/1971 |
| DE | 9400886 | 5/1994 |
| GB | 2147883 | 5/1985 |

* cited by examiner

*Primary Examiner*—Sherman Bainger
(74) *Attorney, Agent, or Firm*—Dean W. Russell; Kilpatrick Stockton LLP

(57) ABSTRACT

A rigid container having a generally horizontal elongated and non-parallelepiped shape, for containing a pneumatic inflatable life raft in deflated and folded state, is detailed. The container may be formed by two respectively upper and lower mutually assembled half-shells. The lower half-shell has, on its outer convex face, a zone with generally planar axial surface whereby the container can rest in stable position on a subjacent substantially planar support surface.

23 Claims, 6 Drawing Sheets

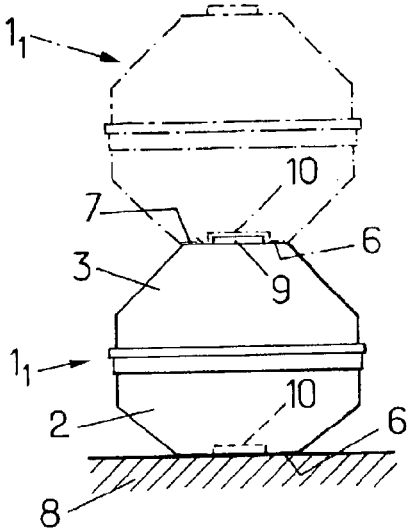
FIG.1.
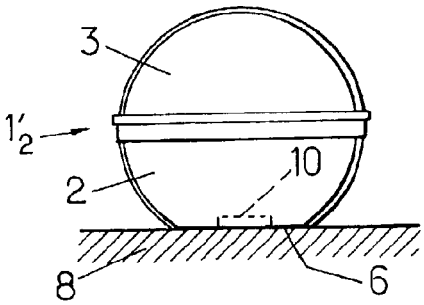
FIG.2.
FIG.3.
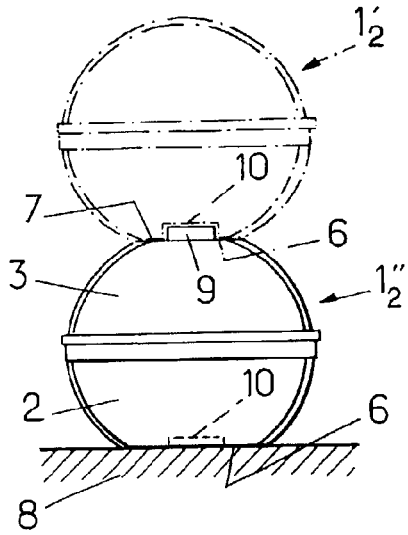
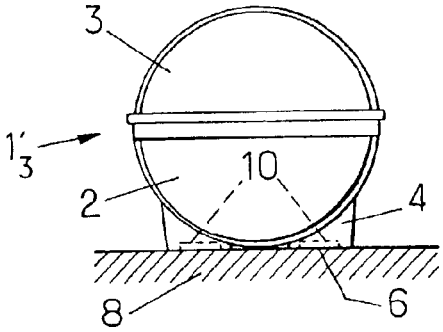
FIG.4.
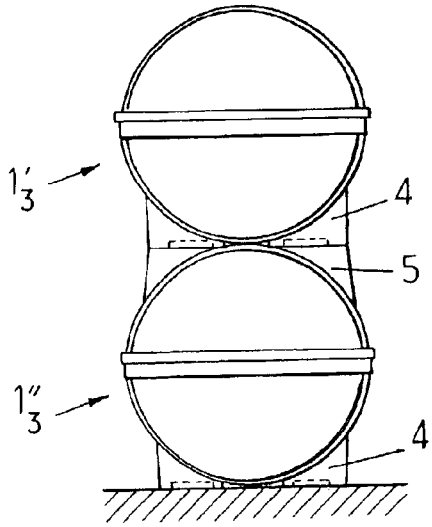
FIG.6.

CONTAINER FOR PNEUMATIC INFLATABLE LIFE RAFT, AND PNEUMATIC INFLATABLE LIFE RAFT EQUIPPED WITH SAME

This application claims priority to French Patent Application No. 00/07919 filed on Jun. 21, 2000 and International Application No. PCT/FR01/01877 filed on Jun. 15, 2001 and published as International Publication No. WO 01/98139 A1 on Dec. 27, 2001, the entire contents of which are hereby incorporated by reference.

FIELD OF THE INVENTION

The present invention relates to improvements made in the field of inflatable life rafts contained, in the deflated and folded storage state, in a rigid container of horizontally elongate and non-parallelepipedal overall shape, said container being formed of two half-shells assembled together.

DESCRIPTION OF THE PRIOR ART

In high-capacity vessels such as passenger ships, car ferries or cruise liners, it is necessary to provide a large number of life rafts, which number is proportionate to the carrying capacity of the vessel. These rafts, houseded in containers, are stored in groups at various points around the vessel.

In the case of vessels of the kind considered which are able to carry several hundreds or even several thousands of individuals, use is made of high-capacity life rafts capable of carrying several tens of individuals (for example 20, 30 or 50 individuals) or even about a 100 individuals or more in the case of rafts which are under development. Such assemblies are very heavy (weighing of the order of 200 kg for example for a container containing a raft for about 30 individuals) and require davits for handling them (inflating, boarding the passengers, launching). As a result, the containers containing the rafts are grouped together side by side under davits and this, on the one hand, takes up a considerable amount of space on vessels and, on the other hand, also requires there to be a great many davits.

A solution that will allow the containers to be grouped together in greater number in fewer locations so that each davit will be able to handle a larger number of rafts has therefore been sought.

Thus, it has been proposed that the containers be superposed and, to do this, it has been proposed that intermediate cradles with two concave sides be provided, and which are able to be inserted between two superposed cylindrical containers, the lower container resting on its own deck cradle.

However, there are several reasons why this solution is not satisfactory.

The circular curvature of the concave places of the cut-outs in the intermediate cradles may not perfectly match the convex curvature of the cylindrical containers: as a result, the weight of the containers may not be uniformly distributed over the cradle. In addition, because of the curved shape of the bearing face, the central region (bottom of the cradle) by itself supports most of the weight of the container, and the worse the fit between the convex curvature of the container and the concave curvature of the cradle, the more this becomes true.

In total, the forces are badly distributed and there is a risk that the lower container will become locally overloaded and damaged.

In addition, again because of the curvature of the bearing regions of the cradles, use of the raft entails first of all that the container be lifted, using a davit, high enough for it to be raised over the lateral horns of the cradles before it can be slewed sideways over the horns of the cradles and made to overhang the sides of the vessel.

As a result, given the insufficient height of certain davits with which vessels are fitted out, it is not in practical terms possible to superpose more than two containers, and even then clearing the upper container may prove tricky, if not to say impossible, if the davit is not tall enough.

Finally, another problem arises, and this is of no lesser importance. When the container has been lifted by the davit, the cradles are removed and thrown onto the deck, precisely in the region where, having unshipped the container, opened it, inflated the raft and brought the raft even with the deck, individuals will board the raft. When several rafts are operated in the same palce at the same time and/or in succession, the relatively large number of cradles lying around on the deck is an impediment to the boarding of the passengers and slows this boarding exercise.

SUMMARY OF THE INVENTION

It is in these circumstances that there is a need on the part of vessel outfitters for a radical solution to be found to the various problems which have hitherto been posed.

It is to these ends that the invention proposes an improved arrangement of containers for a life raft as mentioned in the preamble, which container, being arranged in accordance with the invention, is characterized in that at least the lower half-shell exhibits, on its convex external face, a generally flat axially-extending region by means of which the container can rest stably on a roughly flat underlying support surface.

Advantageously, in addition the upper half-shell too has, on its convex external face, a generally flat axially-extending region, whereby two containers can be stacked one upon the other, the lower half-shell of the upper container resting, via its generally flat region, on the generally flat region of the upper half-shell of the underlying container.

In order to be sure of the cohesion of the stack of several containers, even if the deck of the vessel adopts a significant inclination (in rough seas), it is desirable to make provision for the respective generally flat regions of the lower and upper half-shells to exhibit reliefs of complementing shapes; in particular, it is possible, as a preference, to contrive for the generally flat region of the upper half-shell to exhibit at least one projecting boss and in that the generally flat region of the lower half-shell exhibits at least one hollow impression of a shape that complements said boss.

In one possible embodiment, the container is of approximately prismatic overall shape with an at least pentagonal cross section and the generally flat region consists of one face of the prismatic shape.

In another possible embodiment, the container is of approximately truncated cylindrical overall shape and the generally flat region consists of an axially extending flat intersecting the cylindrical shape.

In either of the above cases, it is also possible to contrive for each half-shell equipped with a generally flat region to further comprise at least one radial protrusion which extends axially on each side of said axially-extending generally flat region and which has a generally flat front face substantially coplanar with said generally flat region, whereby the bearing surface of the container is increased and its stability is improved, particularly transversely, especially when stacked.

In yet another possible embodiment which relates to the common type of container which is of approximately cylindrical, particularly of axisymmetric cylindrical overall shape, provision is made for at least the lower half-shell, and possibly the upper half-shell, to comprise at least one radial protrusion which extends axially and which exhibits a generally flat front face which, at least, is tangential to the external face of the half-shell or lies away beyond it, said front face of the protrusion constituting said generally flat region.

It is possible to manufacture the protrusion as an independent part and then to attach and secure it to the half-shell. However, advantageously and as a preference, each protrusion may be integral with the half-shell, particularly may be molded as an integral part thereof.

In a preferred embodiment, each protrusion is in the overall form of a thick plate extending approximately transversely to the axis of the container and each half-shell is provided with at least two protrusions axially distant from one another.

Still in a preferred embodiment, provision is made for the front face of each protrusion in the form of a thick plate to exhibit at least two bosses or, respectively, two impressions which are transversely distant from one another.

By virtue of the provision of generally flat regions according to the invention, there is produced a container which can easily be stored in stacks. The presence of these flat regions, possibly formed in the form of protrusions or possibly used in conjunction with these stabilizing protrusions, gives an excellent weight distribution and the container situated below no longer runs the risk of being damaged by crushing.

In addition, because of the generally flat shape of the mutual bearing faces of the stacked containers, the upper container can be cleared sideways without having to be raised significantly (a small amount of raising allows the bosses to disengage from the hollow impressions).

Finally, because of the support means being integrated into the half-shells of which the container is made, operation of the raft no longer causes parts likely thereafter to impede the boarding of the passengers onto the raft to be abandoned on the deck.

It will also be noted that the container, which in the prior art offered no stability when placed on a support surface, can now be set down in a perfectly stabilized way: in other words, the supports integrated into the container according to the invention not only provide the required bracing between two superposed containers but also allow the bottom container in the stack to rest stably directly on the deck or directly on an accommodating platform, without the need to resort to special-purpose deck cradles.

What is more, the essential advantages are obtained without this resulting in a prohibitive on-cost in the manufacture of the container.

Finally, the arrangement according to the invention offers the possibility of surmounting a difficulty encountered when operating rafts. A single davit allows three or four containers or stacks of containers grouped together side by side under the davit, in the region of action thereof, to be handled. However, other additional stacks of containers or containers, which might be located further away from the davit, would not be able to be grasped. Provision is therefore made, in the context of the present invention, for the lower half-shell to be equipped with movement means arranged in conjunction with said generally flat region. These means may be in particular gliding pads, for example coated with a material with a low coefficient of friction such as those marketed under the name of nylon, or alternatively castors. In particular, it is possible to make use of the presence of the hollow impressions that accommodate the bosses to house such means, for example giving these hollow impressions a shape and size such that they house said movement means at the same time as accommodating the bosses. Thus, the container can be shifted by manpower to bring it under the davit, or hauled along the deck using the davit used as a winch.

BRIEF DESCRIPTION OF THE DRAWINGS

The invention will be better understood from reading the detailed description of certain embodiments which are given solely by way of nonlimiting examples. In this description, reference is made to the appended drawings in which:

FIG. 1 is an end-on view of a first possible embodiment of a container for an inflatable life raft arranged according to the invention, a second container being drawn in dashed line to illustrate the configuration of a stack of two containers;

FIG. 2 is an end-on view of a second possible embodiment of a container for an inflatable life raft arranged according to the invention;

FIG. 3 is an end-on view of an alternative form of embodiment of the container of FIG. 2, with another container identical to that of FIG. 2, depicted in dashed line, placed on it to illustrate the configuration of a stack of two containers;

FIG. 4 is an end-on view of a preferred third embodiment of a container for an inflatable life raft arranged according to the invention;

FIG. 6 is an end-on view illustrating a stack of two containers combining the two containers of FIGS. 4 and 5;

DETAILED DESCRIPTION OF THE INVENTION

Figure 5:
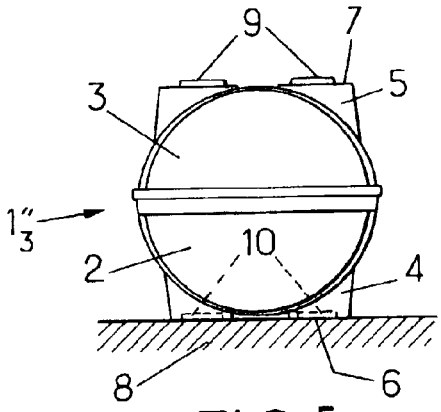
FIG. 5 is an end-on view of an alternative form of embodiment of the container of FIG. 4.

FIG. 1, to which reference is made first of all, shows, in an end-on view, a first embodiment of a container able to contain an inflatable life raft in the deflated and folded state, this container, denoted overall by the reference $1_1$, being arranged according to the invention.

Although this is not an exclusive application of the devices of the invention, the container $1_1$ is assumed to be shaped to contain, in the deflated and folded state, a high-capacity inflatable life raft, for example to carry thirty individuals or more, and all the equipment relating to it.

The container $1_1$ is of horizontally elongate and non-parallelepipedal overall shape and consists of two half-shells, these being a lower one 2 and an upper one 3, respectively, assembled together.

In its entirety, the container is arranged in any way appropriate to its function and its use, particularly as regards its external fittings with a view to lashing it down, handling it using davits, etc. Likewise, its internal equipment—inflatable raft, automatic-opening means, survival means, etc.—is not within the scope of the invention.

In the container arranged according to the invention, the lower half-shell 2 is equipped, on its external convex face, with a generally flat axially-extending region 6 by means of which the container can rest stably on a roughly flat underlying support surface. In the example depicted, the container $1_1$ is placed on a support 8 (the deck of a vessel, platform, etc.).

In the first possible embodiment illustrated in FIG. 1, the container $1_1$ is of lying-down approximately prismatic overall shape, with an at least pentagonal cross section (hexagonal in the example illustrated). In this case, the generally flat region 6 simply consists of one of the lateral faces of the container $1_1$.

In an alternative form of embodiment (which is the one illustrated in FIG. 1), the container is of couched approximately prismatic shape with an even number of sides, which means that at least two mutually opposed sides (the sides 6 and 7 in FIG. 1) are roughly parallel to one another. In this case, it becomes possible for two containers to be superposed one upon the other: the approximately flat region 6 of the lower half-shell 2 of the top container resting on the approximately flat region 7 of the upper half-shell 3 of the underlying container. In FIG. 1, the container $1_1$ on the top of the stack has been depicted in dashed line and is identical to the underlying container $1_1$ depicted in solid line.

To make sure that the stack of several containers remains stable even if the deck of the supporting vessel becomes inclined (rough seas), provision is advantageously made for the respectively generally flat regions 6 and 7 of the lower 2 and upper 3 half-shells to exhibit reliefs of complementing shapes able to nest together. In particular, as illustrated in FIG. 1, the generally flat region 7 of the upper half-shell 3 has at least one projecting boss 9 and the generally flat region 6 of the lower half-shell 2 exhibits at least one hollow impression 10 of a shape that complements the aforesaid boss 9 and into which the latter fits.

FIG. 2 illustrates, in an end-on view, a second possible embodiment whereby the container $1'_2$ is of approximately truncated cylindrical overall shape: the generally flat region 6 consists of an axially extending flat intersecting the cylindrical overall shape of at least the lower half-shell 2.

For such a container to be stackable, provision is made for the upper half-shell 3 too to be in the form of a half-cylinder truncated by an axially extending flat forming a generally flat region 7. FIG. 3 illustrates a container $1''_2$ thus arranged, in which there is arranged, depicted in dashed line, a second container $1'_2$ similar to the one of FIG. 2. For the remainder, the containers $1'_2$ and $1''_2$ may exhibit the same retaining arrangements (boss 9, hollow impression 10) as those set out above in respect of the container $1_1$ of FIG. 1.

FIG. 4 depicts an end-on view of a third embodiment, which is preferred, of a container $1'_3$ arranged according to the invention. The container $1'_3$ exhibits an approximately cylindrical, particularly axisymmetrical, overall shape which is the common overall shape of high capacity inflatable life raft containers. As illustrated in FIG. 4, the lower half-shell 2 has at least one radially extending protrusion 4 (that is to say a protrusion that is transversal to the axis of the container) exhibiting a front face 6 (that is to say, in this case, a lower face) which is generally flat and which, at least, is more or less tangential to the convex semi-cylindrical wall of the half-shell 2 or which extends slightly beyond the semi-cylindrical wall as shown in FIG. 4.

The protrusion 4 thus forms a support which is able to rest stably by its front face 6 on a roughly flat underlying support surface (for example the ground 8 in FIG. 4, or a support platform).

Figure 7:
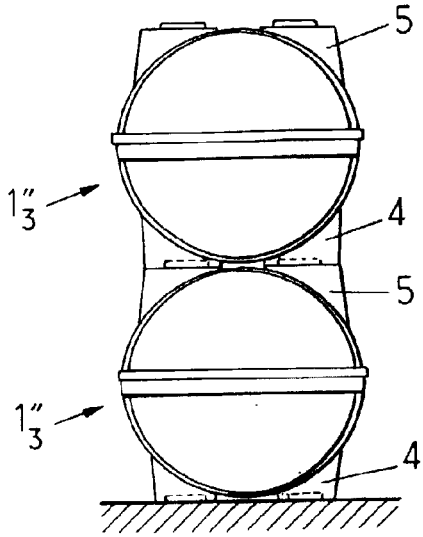
FIG. 7 is an end-on view illustrating a stack of two containers which are identical to the one in FIG. 5.

Advantageously, it is possible also for the upper shell 3 to be equipped with at least one protrusion 5, just like the lower half-shell 2, as illustrated in FIG. 5 in the case of the container $1''_3$. Because the lower 4 and upper 5 protrusions have identical overall shape, the protrusion 5 may, for its part, form a stable support on which the lower support 4 of another container can rest: it is thus possible for two containers to be stacked one upon the other as illustrated in FIG. 6 where the upper container is the container $1'_3$ illustrated in FIG. 4 or as illustrated in FIG. 7 where the upper container is the container $1''_3$ illustrated in FIG. 5.

To form a stable stack, the front faces 6 and 7 of the respective protrusions 4 and 5 associated with the respective half-shells 2, 3 exhibit the aforesaid reliefs of mutually complementing shapes which can nest in one another and prevent the upper container from sliding. As illustrated in FIGS. 4 to 7, these complementing reliefs may comprise one or more projecting bosses 9 provided, for example, on the front face 7 of the upper protrusion 5 and one or more hollow impressions 10 then provided, for example, on the front face 6 of the lower protrusion 4. Thus, these mutually nesting reliefs 9, 10 do not impede the bearing of an isolated container or of the lower container of a stack on the floor or on a receiving platform. Moreover, it is possible to make provision for such a receiving platform itself to be equipped with protruding bosses able to retain the container.

This configuration of the collaborating front faces 6, 7 of the protrusions does not, of course, preclude appropriate lashing-down of the stack of containers.

A container arranged according to the third embodiment of the invention with its lower 4 and possibly upper 5 protrusions may be produced in any appropriate way making it possible to obtain a device which is strong and one-piece in use.

Thus, the protrusions 4, 5 can be manufactured in the form of individual members and then be secured to the respective half-shells by any appropriate means (welding, bonding, screw fastening, etc.). This approach could prove beneficial not so much when manufacturing new containers, but particularly when converting existing containers to make them stackable.

To manufacture new containers, which are generally made of synthetic material, it will preferably be contrived for each support 4, 5 to be integral with the corresponding half-shell 2, 3, respectively, and in particular to be molded as an integral part thereof.

Figure 8:
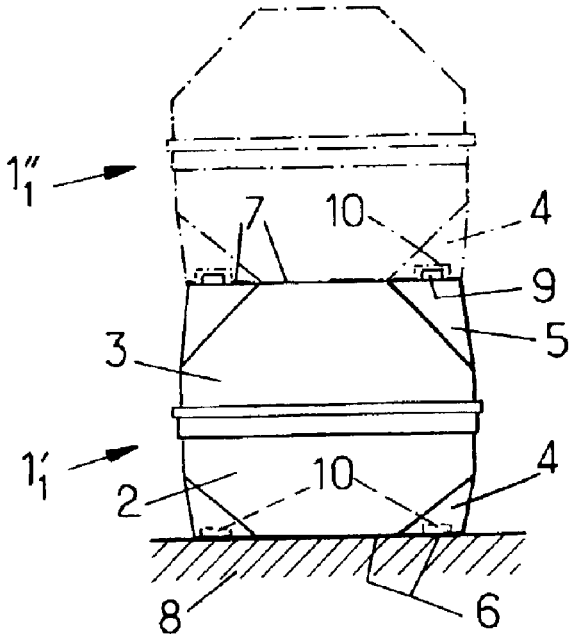
FIG. 8 is an end-on view of an alternative form of embodiment of the first embodiment of the container of FIG. 1, incorporating the arrangement of the containers illustrated in FIGS. 4 and 5, with an alternative form depicted in dashed line, placed on it, to illustrate the configuration of a stack.

It can be emphasized that the use of the protrusions 4, 5 is not reserved for containers of cylindrical, particularly axisymmetric cylindrical type. Indeed, it is possible for a prismatic container according to the first embodiment described above to be equipped with such protrusions as illustrated in FIG. 8: in that figure, the lower container $\mathbf{1'}_1$ is equipped with two protrusions 4 and 5 secured respectively to its lower 2 and upper 3 half-shells, said protrusions then advantageously being shaped in such a way that their respective front faces are roughly coplanar with the respective lower 6 and upper 7 generally flat regions. The presence of the protrusions 4, 5 gives the advantage of broadening the footprint of the container in the transverse direction and thereof of improving its stability.

Still in FIG. 8, dashed line has been used to depict a second container $\mathbf{1''}_1$ stacked on the aforesaid container $\mathbf{1'}_1$, this second container $\mathbf{1''}_1$ being equipped only with at least one lower protrusion 4 (which means that it can be used only by itself or at the top of the stack).

The reliefs 9, 10 could possibly be provided in the protrusions 4, 5.

Figure 9:
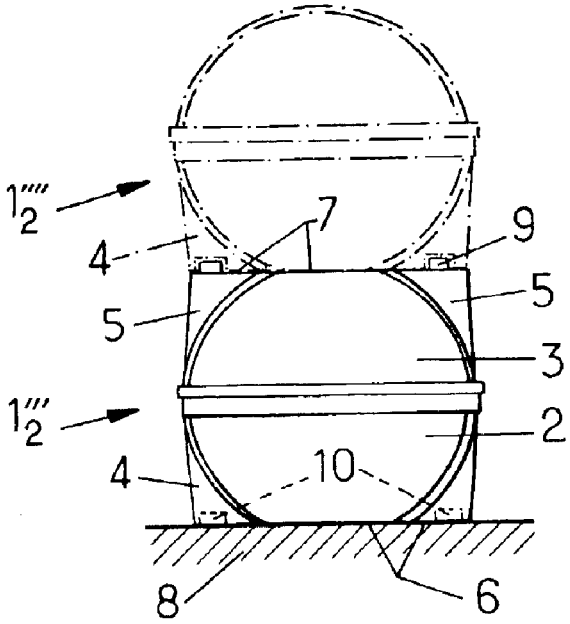
FIG. 9 is an end-on view of an alternative form of embodiment of the second embodiment of the container of FIG. 2, incorporating arrangements of the containers illustrated in FIGS. 4 and 5, with an alternative form, depicted in dashed line, placed on it to illustrate the configuration of a stack.

In the same way, protrusions 4, 5 may, for the same reasons, equip a container of truncated cylindrical overall shape as illustrated in FIG. 9. The explanations given hereinabove with regard to FIG. 8 are also valid in respect of the containers $\mathbf{1'''}_2$ and $\mathbf{1''''}_2$ stacked in FIG. 9.

It is possible to anticipate various embodiments of the protrusions 4, 5. The explanations which follow are given, to enable a concrete idea to be formed, in relation to a container of cylindrical overall shape which constitutes the preferred embodiment of the invention.

Figure 10:
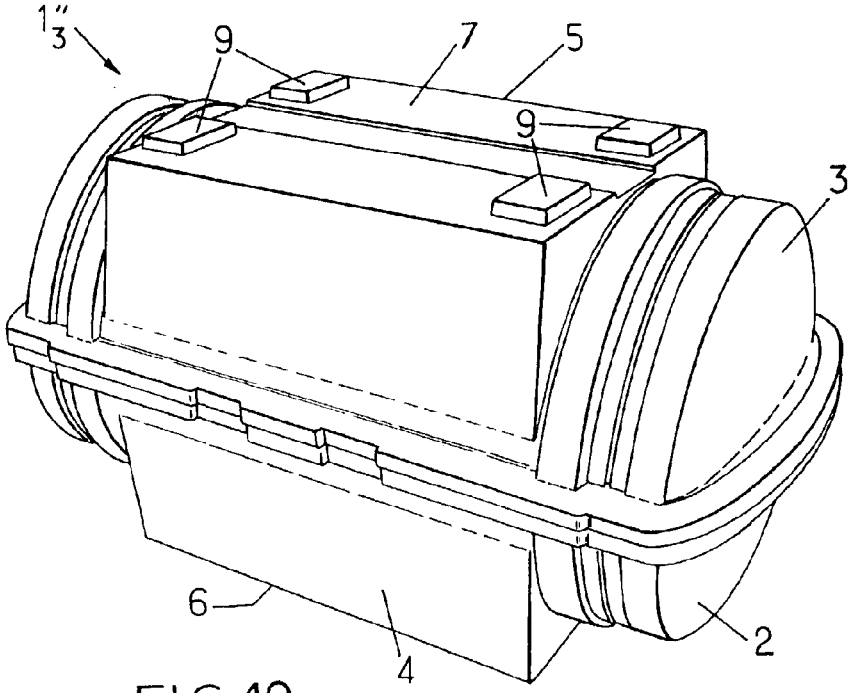
FIG. 10 is a three quarter perspective view from the side and slightly from above, of one possible embodiment of the container of FIG. 5.

FIG. 10 illustrates one possible embodiment (in the configuration of the container $\mathbf{1''}_3$ of FIG. 5) whereby each protrusion 4, 5 is in the form of an approximately parallelepipedal or trapezoidal block, a curved face of which hugs the convex face of the corresponding half-shell and which extends axially over most of the length of the half-shell. In the case of the upper protrusion 5 which is best visible in FIG. 10, its front face 7 is equipped with, for example, two pairs of projecting knobs 9 arranged respectively near its two ends.

Although this meets the desired aims, protrusions of solid shape such as those illustrated in FIG. 10 carry the risk of undesirably increasing the bulk and weight of the container and of impeding operation of the life raft.

Figure 11:
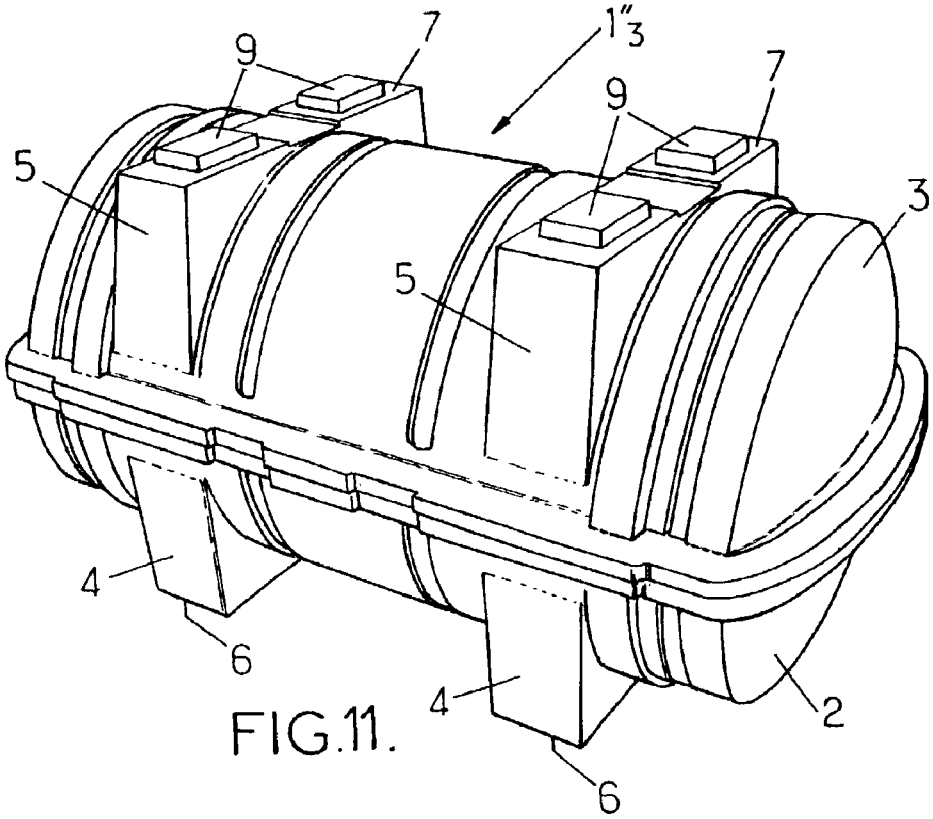
FIG. 11 is a view in three quarter perspective from the side and slightly from above of a preferred embodiment of the container of FIG. 5.

As a result, FIG. 11 shows another, preferred, embodiment (also in the configuration of the container $\mathbf{1''}_3$ of FIG. 5) whereby each protrusion 4, 5 is in the form of a thick plate extending approximately transversely to the axis of the corresponding half-shell and each half-shell of the container is equipped with two protrusions in the form of thick plates axially distant from one another and situated approximately near the ends of the half-shell.

As better visible in FIG. 11, the front face 7 of the upper protrusions 5 is equipped with two projecting knobs 9 transversely distant from one another.

Figure 12:
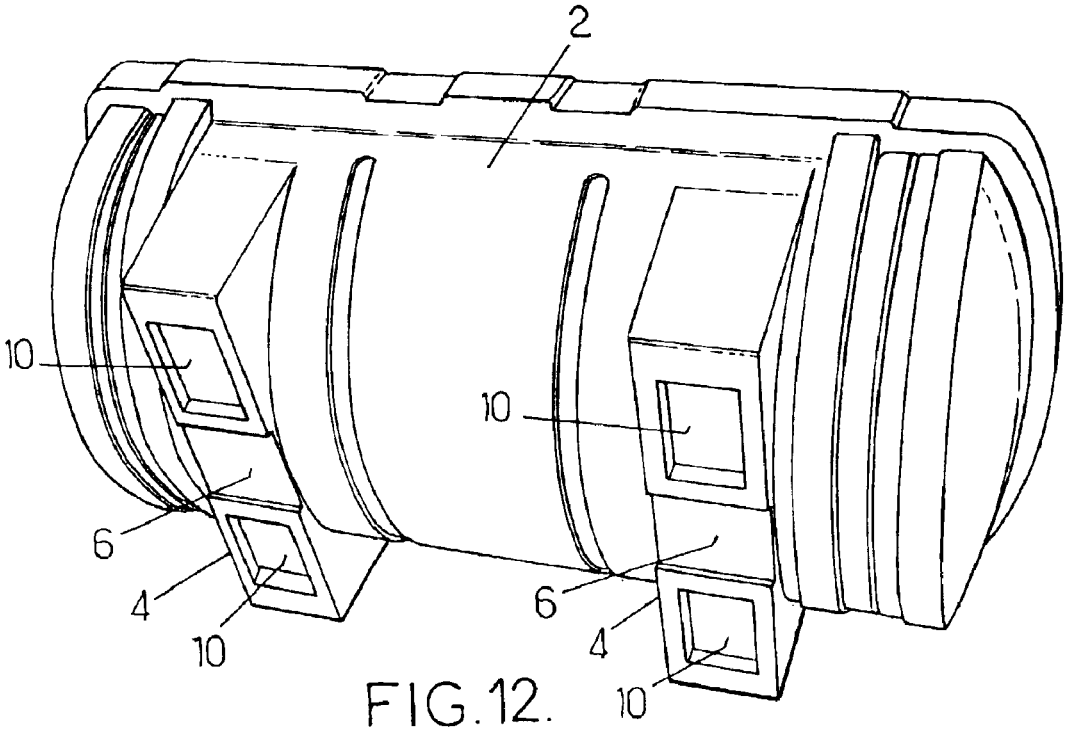
FIG. 12 is a view in perspective from beneath of the lower half-shell of the container of FIG. 11.

As can be seen better in FIG. 12 which shows the lower half-shell 2 in the couched position, the front face 6 of the lower protrusions 4 is equipped with two hollow impressions 10 which are transversely distant from one another to correspond with the projecting knobs 9 and which are shaped (shape, size, depth) to complement the projecting knobs 9.

Figure 13:
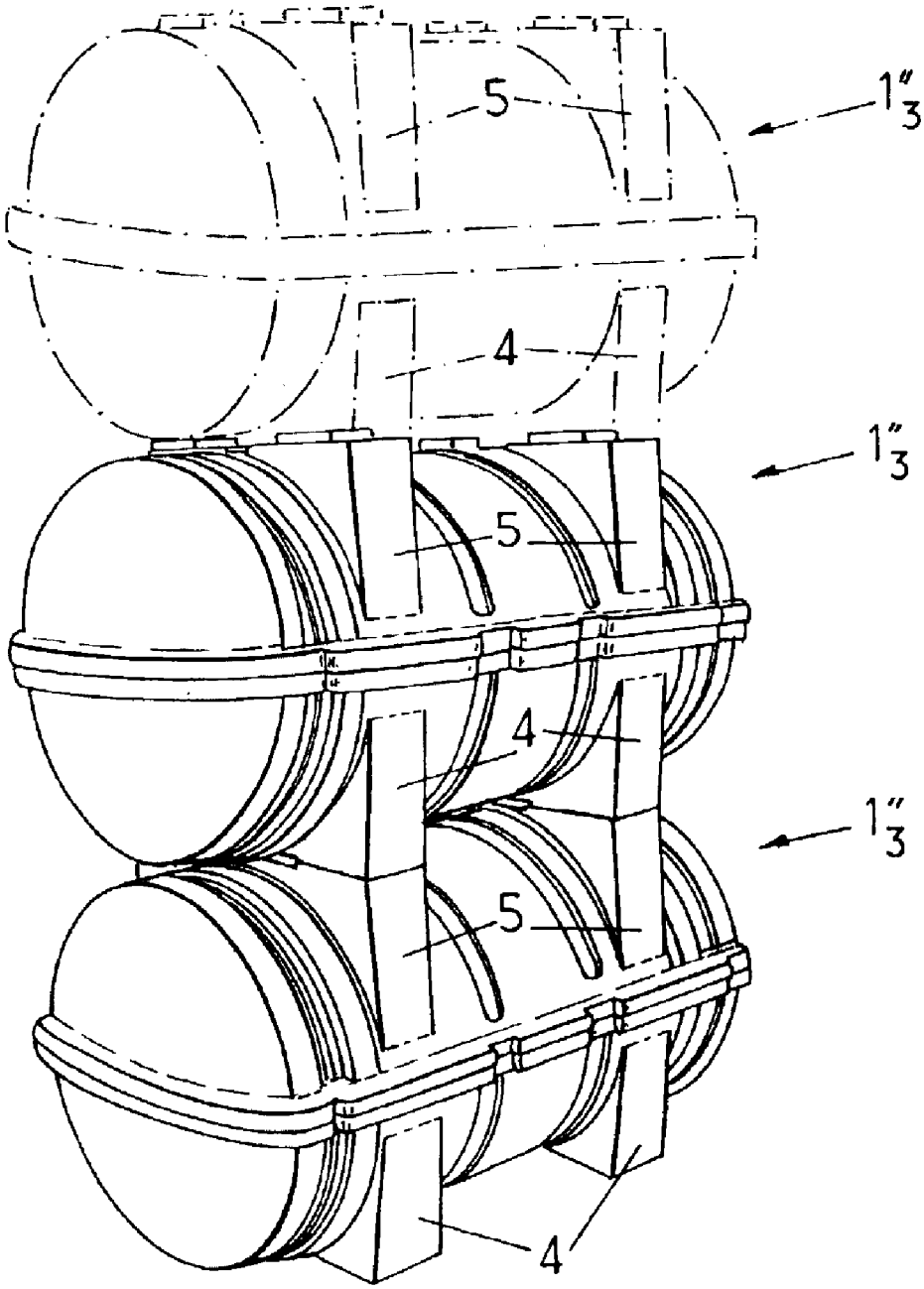
FIG. 13 is a perspective view of a stack of two containers which are identical to the one in FIG. 11, a third container being depicted in dashed line.

To give a more concrete idea, FIG. 13 illustrates, in perspective, a stack of two containers $\mathbf{1''}_3$ arranged according to the preferred embodiment of FIGS. 11 and 12. Such a stack is stable, occupies a smaller area on the ground than the two containers juxtaposed and remains easy to handle using the davits with which vessels are currently equipped. To operate it and, in particular, to unship it, the upper container does not need to be raised very far: all that it needs is for the hollow impressions 10' of the protrusions 4 of its lower half-shell 2 to be disengaged over the protruding bosses 9 of the protrusions 5 of the upper half-shell 2 of the underlying container. Once the container has been lifted and unshipped, no parts remain lying around on the deck and, once the raft has been inflated and brought even with the deck, the passengers can board unimpeded.

This same FIG. 13 depicts, in dashed line, a third container $\mathbf{1''}_3$ which extends the stack. Of course, the upper container could just as easily be of the type which has no protrusions on the upper half-shell (container $\mathbf{1'}_3$ of FIG. 4). Such an assembly (or even an assembly which is even taller comprising four or five containers) can, in theory, be produced perfectly well and the presence of the protrusions 4, 5 yields a load distribution which avoids any deformation and any damage to the half-shells. However, such stacks cannot be produced, because of their great height, unless the handling davits are configured accordingly.

FIGS. 11 to 13 more specifically illustrate containers for high-capacity rafts (for example carrying thirty or more individuals). The arrangements of the invention can, of course, be adapted to rafts of any size; in particular for very high-capacity rafts (for example those for 100 or 150 individuals) which are far bulkier in the deflated and folded state, the containers may, for example, be longer. If it is desirable for two such containers to be stacked, provided that the mechanical strength of the two half-shells so permits, it may be necessary to provide an intermediate third support on each half-shell so as to obtain better weight distribution and avoid deformation of the underlying container in the stack.

It will also be noted that each protrusion 4, 5 can admissibly project appreciably in the radial direction with respect to the central generatrix of the semi-cylindrical half-shell. However, in order not to increase, in an ill-considered way, the height of the container and therefore the height of a stack of several containers, it is desirable for the protrusions 4, 5 not to project appreciably with respect to the central generatrix of the semicylindrical half-shell and for the front faces 6, 7 of the protrusions to be to be tangential or almost tangential to the half-shell, as illustrated in the various figures.

Figure 14:
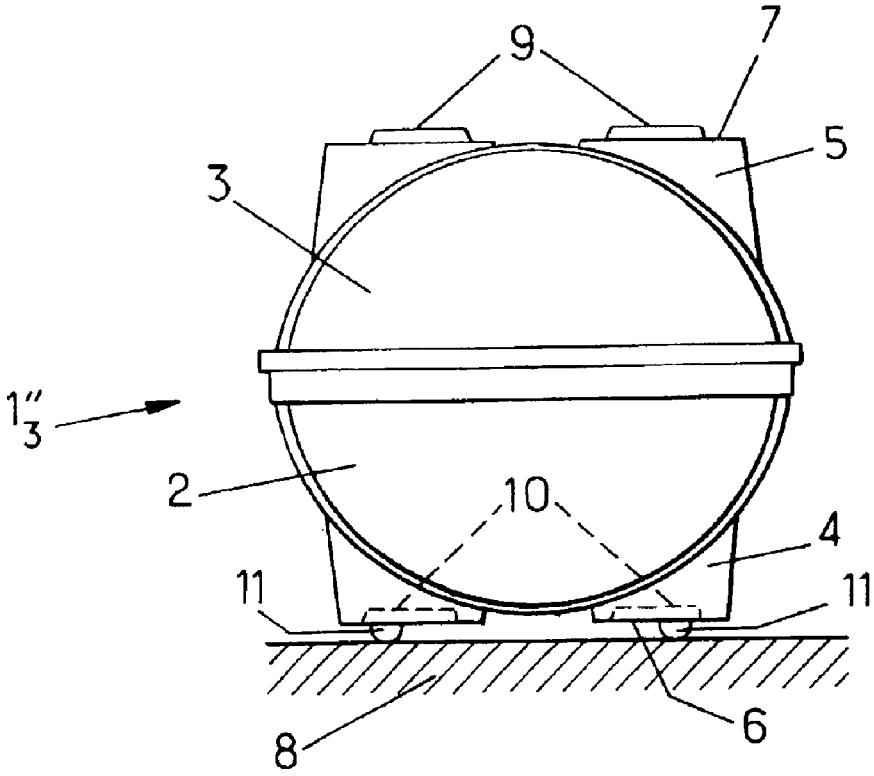
FIG. 14 is an end-on view of the container of FIG. 5, showing an alternative form of arrangement of the lower half-shell.

Finally, it is possible for the isolated container or the lower container of a stack to rest directly on the deck of the vessel. It is then possible to enjoy the arrangement of the container according to the invention to make it, in conjunction with said generally flat region 6, bear movement means able to make the container easier to move along the deck, for example in particular so that a container distant from its handling davit can be brought up by manpower or using the davit used as a winch. For this purpose, it is possible for the container to be equipped with gliding pads, particularly ones coated in a material with a low coefficient of friction (such as the material marketed by the name of Nylon, for example). It is also possible to make provisions for the container to be equipped with castors. As illustrated in FIG. 14, such movement members 11 can be housed in the hollow impression 10 of the lower half-shell which have been advantageously configured in terms of area and in terms of depth so that they can, on the one hand, accommodate the bosses 9 under the conditions set out above and, on the other hand, house said movement members.

What is claimed is:

1. A rigid life-raft container of horizontally elongate and non-parallelepipedal overall shape, defining means for housing an inflatable life raft in the deflated and folded state, said container being formed as two half-shells, these being a lower one and an upper one respectively, assembled together, wherein each of the upper and lower half-shells exhibits, on an external face, a generally flat axially-extending region, whereby two containers can be stacked one upon the other, the lower half-shell of the upper container resting, via its generally flat region, on the generally flat region of the upper half-shell of the underlying container.

2. The life-raft container according to claim 1, wherein the respective generally flat regions of the lower and upper half-shells exhibit reliefs of complementing shapes.

3. The life-raft container according to claim 1, wherein the respective generally flat regions of the lower and upper half-shells exhibit reliefs of complementing shapes, wherein said generally flat region of the upper half-shell exhibits at least one projecting boss, and wherein the generally flat region of the lower half-shell exhibits at least one hollow impression of a shape that complements said boss.

4. A rigid life-raft container of horizontally elongate and approximately prismatic overall shape, defining means for housing an inflatable life raft in the deflated and folded state, said container being formed as two half-shells, these being a lower one and an upper one respectively, assembled together, wherein at least the lower half-shell exhibits, on an external face, a generally flat axially-extending region (i) comprising one face of the prismatic shape and (ii) by means of which the container can rest stably on a roughly flat underlying support surface.

5. A rigid life-raft container of horizontally elongate and approximately truncated cylindrical overall shape, defining means for housing an inflatable life raft in the deflated and folded state, said container being formed as two half-shells, these being a lower one and an upper one respectively, assembled together, wherein at least the lower half-shell exhibits, on an external face, a generally flat axially-extending region (i) comprising an axially extending flat intersecting the cylindrical shape and (ii) by means of which the container can rest stably on a roughly flat underlying support surface.

6. The life-raft container according to claim 4, wherein each half-shell equipped with a generally flat region further comprises at least one radial protrusion which extends axially on each side of said axially-extending generally flat region and which has a generally flat front face substantially coplanar with said generally flat region, whereby the bearing surface of the container is increased and its stability is improved, especially when stacked.

7. The life-raft container according to claim 6, wherein said protrusion is attached and fixed to the half-shell.

8. The life-raft container according to claim 6, wherein said protrusion is molded as an integral part of the half-shell.

9. The life-raft container according to claim 6, wherein each protrusion is in the overall form of a thick plate extending approximately transversely to the axis of the container and wherein each half-shell is provided with at least two protrusions axially distant from one another.

10. The life-raft container according to claim 6, wherein the front face of each protrusion in the form of a thick plate exhibits at least two bosses or, respectively, two impressions which are transversely distant from one another.

11. The life-raft container according to claim 5, wherein each half-shell equipped with a generally flat region further comprises at least one radial protrusion which extends axially on each side of said axially-extending generally flat region and which has a generally flat front face substantially coplanar with said generally flat region, whereby the bearing surface of the container is increased and its stability is improved, especially when stacked.

12. The life-raft container according to claim 11, wherein said protrusion is attached and fixed to the half-shell.

13. The life-raft container according to claim 11, wherein said protrusion is molded as an integral part of the half-shell.

14. The life-raft container according to claim 11, wherein each protrusion is in the overall form of a thick plate extending approximately transversely to the axis of the container and wherein each half-shell is provided with at least two protrusions axially distant from one another.

15. The life-raft container according to claim 11, wherein the front face of each protrusion in the form of a thick plate exhibits at least two bosses or, respectively, two impressions which are transversely distant from one another.

16. The life-raft container according to claim 1, wherein this container is of axisymmetric cylindrical overall shape, and wherein at least the lower half-shell comprises at least one radial protrusion which extends axially and which exhibits a generally flat front face which, at least, is tangential to the external face of the half-shell or lies away beyond it, said front face of the protrusion constituting said generally flat region.

17. The life-raft container according to claim 16, wherein said protrusion is attached and fixed to the half-shell.

18. The life-raft container according to claim 16, wherein said protrusion is molded as an integral part of the half-shell.

19. The life-raft container according to claim 16, wherein each protrusion is in the overall form of a thick plate extending approximately transversely to the axis of the container and wherein each half-shell is provided with at least two protrusions axially distant from one another.

20. The life-raft container according to claim 16, wherein the front face of each protrusion in the form of a thick plate exhibits at least two bosses or, respectively, two impressions which are transversely distant from one another.

21. The life-raft container according to claim 1, wherein (i) the generally flat region has hollow impressions and (ii) the lower half-shell is equipped with movement means arranged in conjunction with said generally flat region, in the hollow impressions of said generally flat region.

22. The life-raft container according to claim 1, and of approximately cylindrical, or approximately prismatic shape, further comprising the life raft contained therein in a deflated and folded state.

23. The life-raft container according to claim 22, in which the life raft contained therein is a high-capacity raft able to carry at least several tens of individuals.

* * * * *